United States Patent [19]

Brinker

[11] Patent Number: 4,596,101

[45] Date of Patent: Jun. 24, 1986

[54] CONTINUOUS UNFOLDING SPACING TIE

[76] Inventor: Sheridan F. Brinker, 1621 Sweem St., Oroville, Calif. 95965

[21] Appl. No.: 623,509

[22] Filed: Jun. 22, 1984

[51] Int. Cl.[4] ..... E04B 1/94

[52] U.S. Cl. ..... 52/317; 52/693

[58] Field of Search ..... 272/109; 52/105, 108, 52/317, 345, 364–369, 488, 490, 693, 695, 696

[56] References Cited

U.S. PATENT DOCUMENTS

| | | | |
|---|---|---|---|
| 1,106,845 | 8/1914 | Ream | 52/695 |
| 1,204,956 | 11/1916 | Day | 52/695 |
| 1,514,577 | 11/1924 | Burrell | 52/695 |
| 1,523,970 | 1/1925 | Jakob | 52/317 |
| 1,656,741 | 1/1928 | Lane | 52/695 |
| 2,964,807 | 12/1960 | Kennedy | 52/693 |
| 3,010,162 | 11/1961 | Klein | 52/696 |
| 3,334,461 | 8/1967 | York | 52/317 |
| 3,959,945 | 6/1976 | Allen | 52/690 |
| 4,040,232 | 8/1977 | Snow et al. | 52/693 |

FOREIGN PATENT DOCUMENTS

| | | | |
|---|---|---|---|
| 511501 | 4/1955 | Canada | 52/696 |
| 1021131 | 11/1977 | Canada | 52/693 |
| 2419084 | 11/1979 | France | 272/109 |

*Primary Examiner*—John E. Murtagh
*Assistant Examiner*—Andrew Joseph Rudy
*Attorney, Agent, or Firm*—Norman B. Rainer

[57] ABSTRACT

A continuous sequence of thin spacer/bracing segments is provided in the form of an accordian-folded nested stack. Each segment is comprised of a center panel, one side of which is provided with a downwardly angled side appendage panel, the other side of the center panel being free of any appendages. A tang portion at each extremity of the center panel has no side panel associated therewith. In use, the segments are drawn from the stack and utilized to position and brace wooden structural members in the production of an equidistantly spaced parallel array of said structural members. Because of the thin nature of the segments, they may be left in place when paneling material is placed upon the array of structural members.

7 Claims, 6 Drawing Figures

FIG. 5
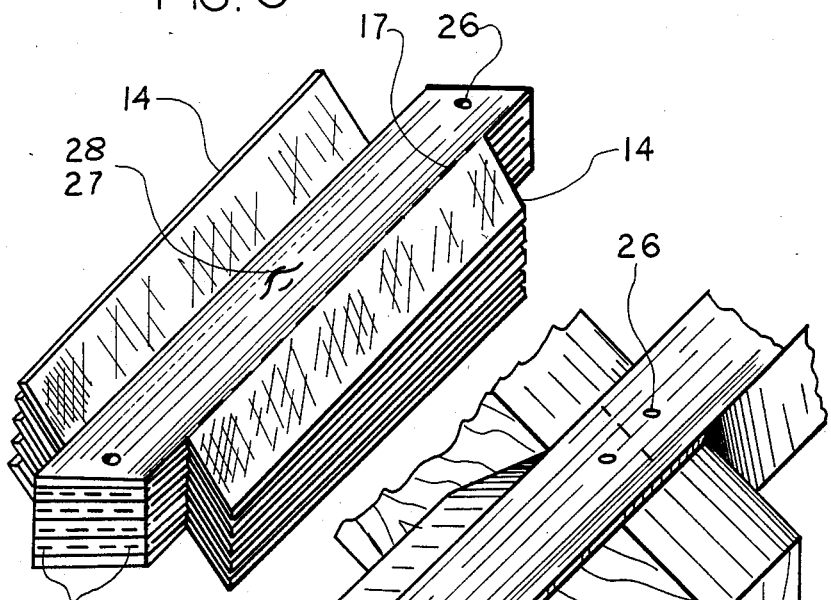
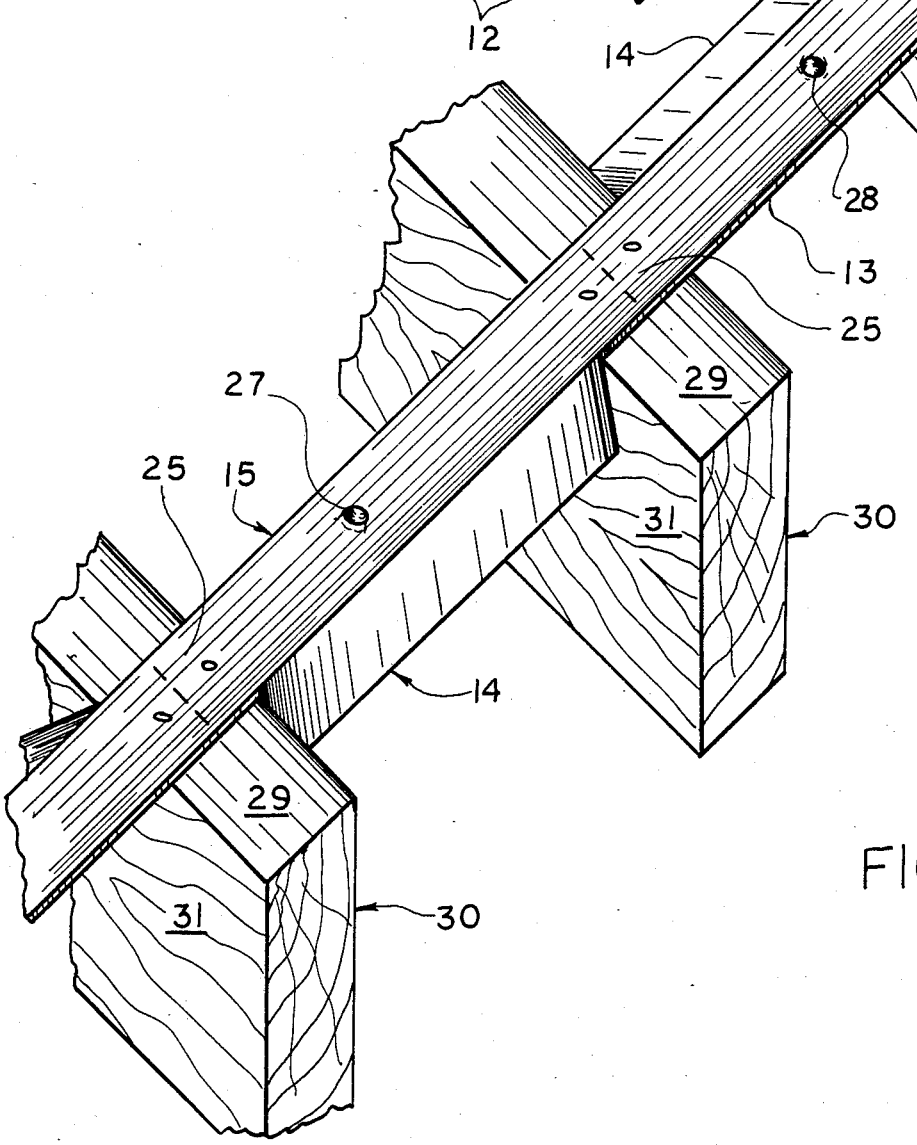
FIG. 6

CONTINUOUS UNFOLDING SPACING TIE

BACKGROUND OF THE INVENTION

This invention relates to brace elements for use in building and home construction, and more particularly concerns a spacing brace which can be quickly and easily applied to connect a series of parallel wooden structural members in a highly economical fashion.

In the construction of buildings, wooden structural members known as studs, joists, trusses and rafters are generally utilized wherein a number of such members are equidistantly disposed in a parallel array. The distance between said members is generally determined by measuring with a ruler and/or utilizing wooden strips of 1×2-inch cross section which are removably nailed into the structural members for temporary securement. Repeated measurements can be time-consuming and susceptible to random errors. Furthermore, after the structural members are fixed in their desired positions, any temporary wooden strips and their holding nails must be removed to permit the roof, wall or floor sheeting to be installed. Not only is such removal time-consuming, but the wooden strips are frequently discarded as scrap, resulting in the waste of expensive lumber and presenting a disposal problem.

It is also well known to nail bracing elements called ties between adjacent beams once the parallel array is formed in order to strengthen the array. In particular, such procedure improves lateral stability and distributes loading forces throughout the assembly. Although effective, such procedure is costly in terms of labor and materials.

It is accordingly an object of the present invention to provide apparatus to efficiently and economically position and engage wooden structural members such as trusses, joists, studs and rafters in an equidistantly spaced parallel array of a number of said structural members.

It is a further object of the present invention to provide spacing apparatus as in the foregoing object wherein the spacer remains permanently attached to the structural member in a manner to increase the strength of interengagement of said array of structural members.

It is another object of this invention to provide spacing apparatus of the aforesaid nature adapted to serve as a bracing member to stabilize the array of structural members during construction and thereafter.

It is a still further object of the instant invention to provide an improved spacing apparatus which is easily utilized and amenable to economical manufacture.

These objects and other objects and advantages of the invention will be apparent from the following description.

SUMMARY OF THE INVENTION

The above and other beneficial objects and advantages are accomplished in accordance with the present invention by an improved spacing apparatus which comprises an integral strip of thin gauge material comprised of sequentially contiguous spacer segments separated by a zone predisposed to folding of the strip in a direction transverse to its long axis, said strip being in the form of an accordian-folded stack wherein adjacent spacer segments lie in contact in oppositely directed back-and-forth folds. Each spacer segment is comprised of: (a) a center panel of rectangular configuration centered upon and elongated along the midline axis of the strip, having substantially flat upper and lower surfaces, and first and second long side edges which alternate in position in adjacent spacer segments, (b) a side panel emergent from said first long side edge as a continuous integral appendage thereof, downwardly angled therefrom and having a shorter length than the associated center panel, (c) tang portions disposed at each extremity of said center panel as coplanar continuous integral extensions thereof, and (d) nailreceiving apertures located within said tang portions.

By virtue of the alternating succession of the side panels with respect to the midline axis of the strip, and their overlying juxtaposition with the second long side edges which are free of appendages, the spacer segments nest in close-fitting contact in the folded state of the spacing apparatus.

In a preferred embodiment, registering means are associated with said center panel to stabilize the nested configuration. Said registering means may be an alternating series of depressions and attendant protrusions centered in said center panels.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing:

FIG. 5 is a sectional view taken along the line 5—5 of FIG. 2.

FIG. 6 is a perspective view showing the spacing apparatus of FIG. 3 in its unfolded state and in operational engagement with adjacent parallel wooden structural members.

DESCRIPTION OF THE PREFERRED EMBODIMENT

Figure 1:
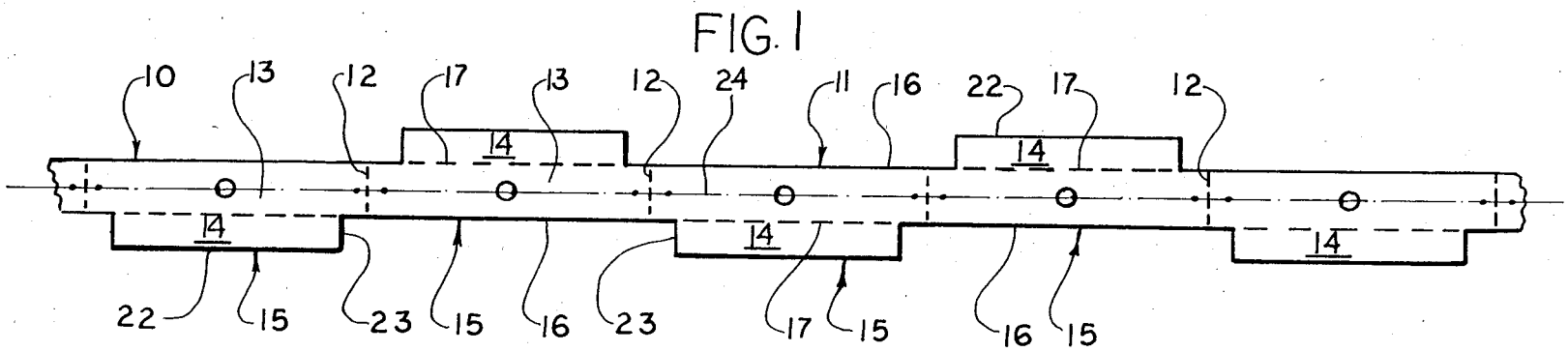
FIG. 1 is a fragmentary plan view of a strip of metal from which an embodiment of the spacing apparatus of the instant invention may be constructed by bending and folding operations.

Referring now to the figures, the exemplified embodiment of the spacing apparatus 10 of this invention is formed from a monolithic strip 11 of flat metal sheet stock having the initial configuration shown in FIG. 1. The metal strip, preferably 20 to 22 gauge galvanized iron, is seen to have uniformly spaced parallel fold lines 12 comprised of weakening slits oriented in a direction perpendicularly transverse to midline axis of elongation 24. In other embodiments, monolithic strip 11 may be fabricated from a stiff grade of plastic material.

Strip 11 is further seen to have a continuous center panel 13 defined by bend lines 17 which constitute first long side edges, and alternating second long side edges 16. Tab-like appendage side panels 14 extend outwardly from said first long side edges as continuous integral extensions of center panel 13. Said side panels, having a rectangular configuration with respect to bend lines 17, have a distal longitudinal edge 22 and straight lateral edges 23 perpendicularly disposed to said center panel. Although side panels 14 are initially coplanar with center panel 13 in the flat strip of sheet stock, said side panels are subsequently bent along bend lines 17 so as to be substantially unidirectionally oriented in an angled relationship to said center panel.

Figure 3:
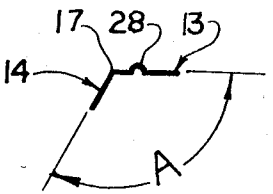
FIG. 3 is a perspective view of a spacing apparatus of this invention in its folded state, formed by the folding of the bent strip of FIG. 2.
Figure 4:
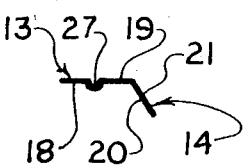
FIG. 4 is a sectional view taken along the line 4—4 of FIG. 2.

The angle between the side and center panels, denoted as Angle A in FIG. 3, will range between about 95° and 175°. In use, the side panels are intended to be downwardly directed with respect to the center panel. Accordingly, that surface of the center panel which faces the side panels is designated lower surface 18, and the opposite surface of said center panel is designated upper surface 19. Similarly, that surface of each side panel which faces center panel 13 is designated inside surface 20, and the opposite surface is designated outside surface 21.

The portions of the continuous strip between adjacent fold lines 12 constitute spacer segments 15. Each spacer segment is comprised of a length of center panel 13, and a side panel 14. The longitudinal extremities of each portion of center panel 13 within a spacer segment are free of associated side panel 14, and are designated as tang portions 25. Said tang portions, which are coplanar continuous integral extensions of center panel 13, are provided with nail-receiving apertures 26.

Figure 2:
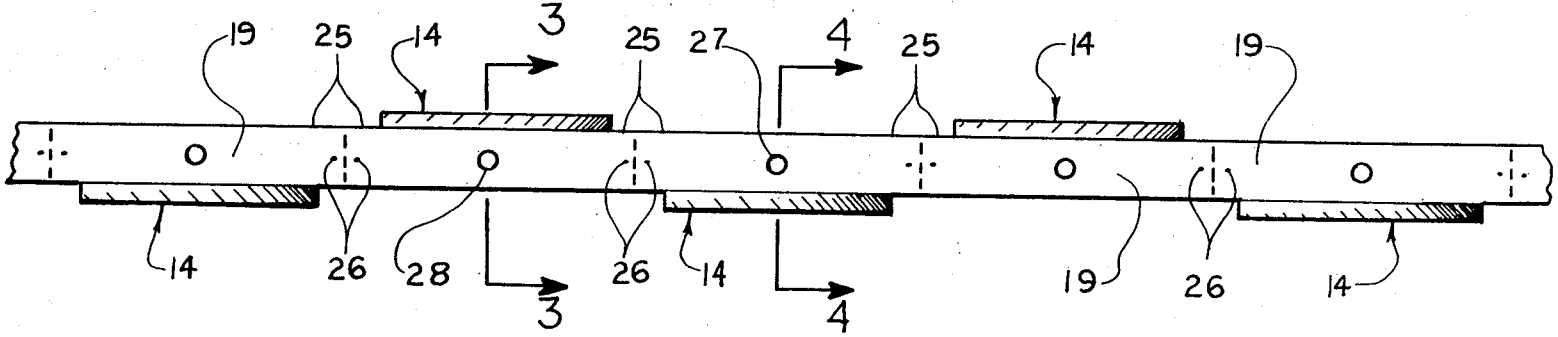
FIG. 2 is a fragmentary plan view of the strip of metal of FIG. 1 in its bent form.

In forming the spacing apparatus of this invention, strip 11, following the bending operation which places side panels 14 in their functional configuration shown in FIG. 2, is folded in an alternating back-and-forth manner about fold lines 12 to produce the folded state shown in FIG. 3. It is only by virtue of the special configuration of the bent form of strip 11 that the tightly nested packing shown in FIG. 3 can be achieved. In particular, it is to be noted that each side panel 14 passes through the open space associated with the second long edge of the next adjacent center panel.

To stabilize the nested state against premature separation, depressions 27 are formed at the midpoint of the lower surface of the center panel of alternate spacer segments. The attendant alternating protrusions 28 are adapted to fit within the depressions of adjacent spacer segments in the folded or nested state, thereby preventing unwanted transverse movement of the folded spacer segments. The heights of said protrusions and depressions may range from about 1/32 to ⅛ inch In operation, the nested state of the spacing apparatus is unfolded and deployed across a series of wooden structural members ready for assemblage as a parallel array. As shown in FIG. 6, tangs 25 are caused to rest upon the edges 29 of wooden beams 30, and are nailed to said edges through apertures 26. The lateral edges 23 of side panels 14 lie in abutting contact with the side faces 31 of beams 30. The specialized design and emplacement of the spacing apparatus thereby provides accurate spacing of beams 30 and affords transverse structural support. Because of the thin nature of center panel 13 and tangs 25, sheeting materials can be laid directly over the spacing apparatus which is left in place on the parallel structural members.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A continous spacing apparatus for engaging the edges and side faces of a number of wooden structural members in producing an equidistantly spaced parallel array of said structural members, said spacing apparatus comprising an elongated strip of thin gauge material having a long axis and comprised of sequentially contiguous spacer segments, each separated by a zone predisposed to folding of the strip in a direction transverse to said long axis, said strip being in the form of an accordian-folded stack wherein adjacent spacer segments lie in nested contact in oppositely directed back-and-forth folds, said spacer segments being comprised of:

(a) a center panel of rectangular configuration centered upon and elongated along said long axis, having substantially flat upper and lower surfaces, and first and second long side edges, (b) a side panel emergent from said first long side edge as a continuous integral appendage thereof and downwardly angled therefrom, and having a shorter length than the associated center panel, (c) tang portions disposed at each extremity of said center panel as coplanar continuous integral extensions thereof, and (d) nail-receiving apertures located within said tang portions.

2. The spacing apparatus of claim 1 fabricated of metal.

3. The spacing apparatus of claim 2 wherein the angle of said side panel with respect to said center panel is between 95° and 175°.

4. The spacing apparatus of claim 3 wherein said second long side edge is free of any appendages.

5. The spacing apparatus of claim 4 wherein registering means are associated with said center panel to stabilize said nested contact.

6. The spacing apparatus of claim 5 wherein said registering means comprise a series of alternating depressions and protrusions centered in said center panels and adapted to interengage in said accordian-folded stack.

7. The spacing apparatus of claim 1 wherein said side panel is bounded in part by lateral edges adapted to lie in abutting contact with the side faces of said wooden structural members.

* * * * *